US008631976B2

(12) United States Patent
Moretti

(10) Patent No.: US 8,631,976 B2
(45) Date of Patent: Jan. 21, 2014

(54) MANUALLY OPERATED PUMP COMPRISING AN ASSEMBLY FOR PRESSURIZATION AND DISPENSING OF FLUID

(75) Inventor: Dario Moretti, Ripalta Cremasca (IT)

(73) Assignee: Lumson S.p.A., Capergnanica (CR) (IT)

( * ) Notice: Subject to any disclaimer, the term of this patent is extended or adjusted under 35 U.S.C. 154(b) by 0 days.

(21) Appl. No.: 13/498,007

(22) PCT Filed: Sep. 23, 2010

(86) PCT No.: PCT/EP2010/064072
§ 371 (c)(1),
(2), (4) Date: Mar. 23, 2012

(87) PCT Pub. No.: WO2011/036218
PCT Pub. Date: Mar. 31, 2011

(65) Prior Publication Data

US 2012/0267399 A1 Oct. 25, 2012

(30) Foreign Application Priority Data

Sep. 25, 2009 (IT) ..... MI2009A1648

(51) Int. Cl.
*B65D 88/54* (2006.01)

(52) U.S. Cl.
USPC ..... 222/321.9; 222/321.2; 222/321.7

(58) Field of Classification Search
USPC ..... 222/321.1, 321.2, 321.7, 321.9, 320, 222/340
See application file for complete search history.

(56) References Cited

U.S. PATENT DOCUMENTS

| | | | | |
|---|---|---|---|---|
| 3,187,960 | A | 6/1965 | Gorman | |
| 3,991,914 | A * | 11/1976 | Kotuby et al. | 222/321.9 |
| 4,228,931 | A * | 10/1980 | Ruscitti et al. | 222/321.2 |
| 4,762,475 | A * | 8/1988 | Fuchs | 417/550 |
| 4,856,677 | A * | 8/1989 | Brunet et al. | 222/94 |
| 6,196,424 | B1 * | 3/2001 | Bougamont et al. | 222/321.9 |
| 7,938,298 | B2 * | 5/2011 | Lee | 222/321.1 |
| 2005/0087564 | A1 * | 4/2005 | Marelli | 222/321.9 |
| 2005/0098585 | A1 * | 5/2005 | Marelli | 222/321.9 |
| 2006/0249540 | A1 * | 11/2006 | Arghyris et al. | 222/321.7 |
| 2008/0093389 | A1 * | 4/2008 | Vasseur et al. | 222/321.9 |
| 2008/0118368 | A1 | 5/2008 | Roy et al. | |
| 2008/0164344 | A1 * | 7/2008 | Lompech et al. | 239/333 |
| 2008/0210713 | A1 | 9/2008 | Langlois et al. | |

FOREIGN PATENT DOCUMENTS

| | | | |
|---|---|---|---|
| EP | 1930085 | A2 | 6/2008 |
| EP | 1949973 | A1 | 7/2008 |
| FR | 2910450 | A1 | 6/2008 |

OTHER PUBLICATIONS

International Search Report dated Dec. 27, 2010 from PCT/EP2010/064072.

* cited by examiner

*Primary Examiner* — Paul R Durand
*Assistant Examiner* — Charles P Cheyney
(74) *Attorney, Agent, or Firm* — Novak Druce Connolly Bove + Quigg LLP

(57) ABSTRACT

A manually operated pump for pressurized dispensing of a fluid product, designed to be fastened to the mouth of a container containing the product. The ensemble of the stem, spring, piston, and retention element form a unitary assembly that can be coupled to cup-shaped body of the pump. The pump includes also a member for connection of the unitary assembly to the cup-shaped body. The connection member includes a shaped portion for retention of the collar that projects from the stem, the portion preventing the exit of the stem from the cup-shaped body when the unitary assembly is inserted into the cup-shaped body.

14 Claims, 6 Drawing Sheets

MANUALLY OPERATED PUMP COMPRISING AN ASSEMBLY FOR PRESSURIZATION AND DISPENSING OF FLUID

CROSS-REFERENCE TO RELATED APPLICATIONS

This application is a §371 National Stage Application of International Application No. PCT/EP2010/064072, filed on 23 Sep. 2010, claiming the benefit of Italian Patent Application No. MI2009A 001648 filed on 25 Sep. 2009.

The present invention relates to a manually operated pump for dispensing fluid substances, according to the precharacterizing part of the independent claim.

As is known to the person skilled in the field, there exist a multiplicity of different types of pump that have been used for some time, above all in the cosmetics and pharmaceutical industries, for dispensing fluid products both in the form of liquids and in the form of creams.

In particular, pumps are known that, in their bottom part, are provided with a tube designed to draw in the fluid to be dispensed and pumps without said tube, which are generally applied on containers of variable volume or else on containers that generally are provided with a mobile bottom element.

Both manufacturers and users of pumps of the type described above are required to keep in stock a multiplicity of different types of pumps so as to always be in a condition to meet the needs of the market.

The documents N. EP1930085, EP1949973, FR2908843, FR2910450 and EP1389491 all describe a pump that comprises an assembly for pressurization and dispensing of fluid substances that can be pre-assembled and then coupled to the other components of a pump, in a conventional way by means of usual engagement members or rings that engage on the mouth of a container on which the pump is mounted.

In known pumps, in order to vary and in particular reduce the amount of fluid dispensed by the pump, it is necessary to replace the entire pressurization/dispensing assembly.

The purpose of the present invention is to provide a pump, which comprises an assembly for pressurization and dispensing of fluid substances that will simplify and render faster the assembly of pumps of different types, for example of the type with dripping tube and of the type without said tube, that will guarantee at all times an optimal and reliable dispensing of the fluid product, and that will enable reduction in a simple and fast way of the amount of fluid dispensed, without having to replace and/or modify also the dispensing/pressurization assembly.

The above and other purposes that will emerge clearly to a person skilled in the field are achieved by a pump in conformance with the characterizing part of the independent claim.

Figure 1:
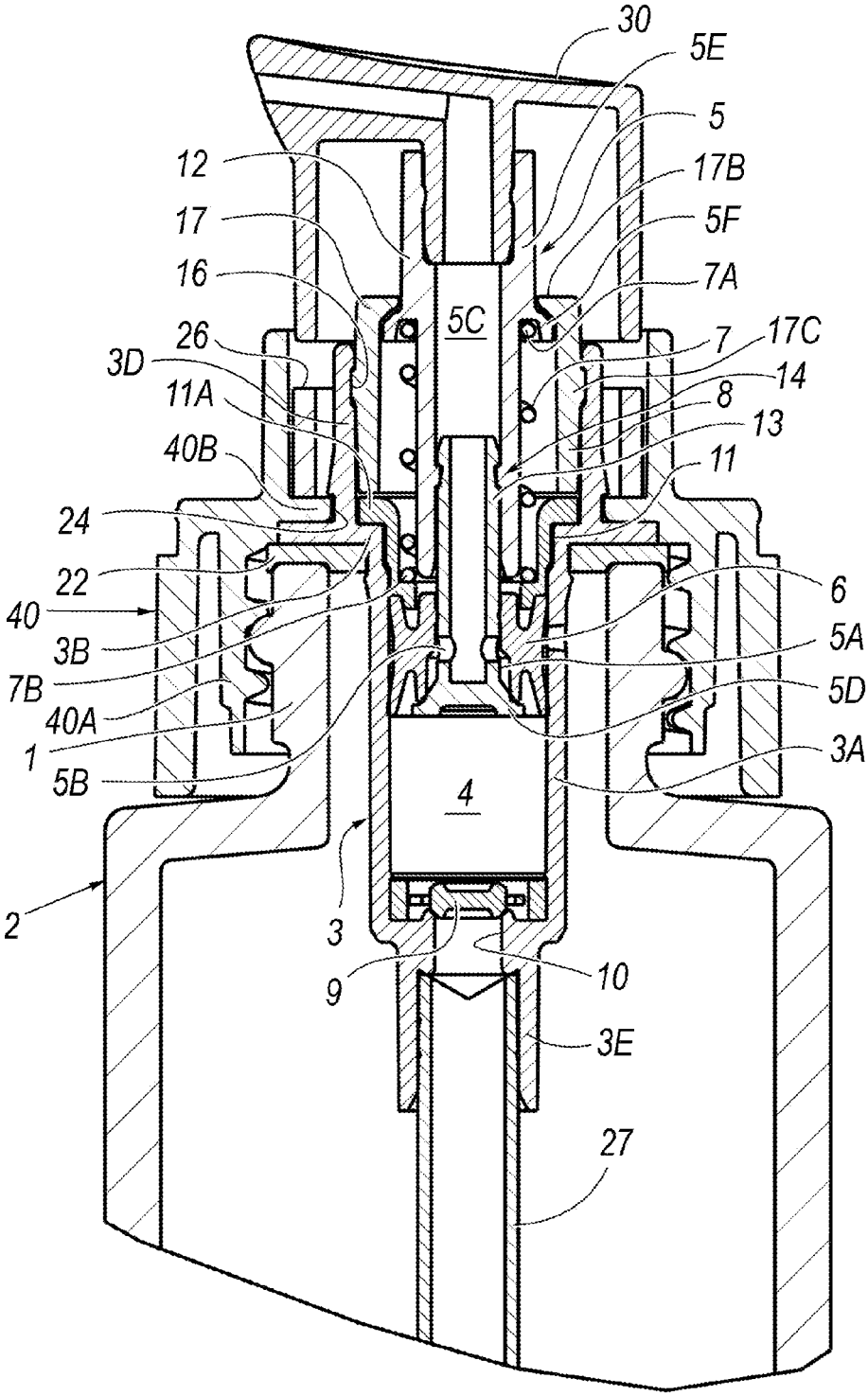
Figure 2A:
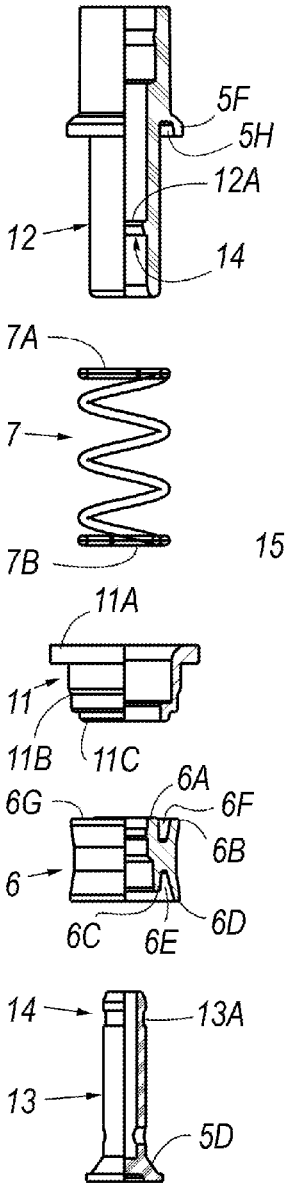
Figure 2B:
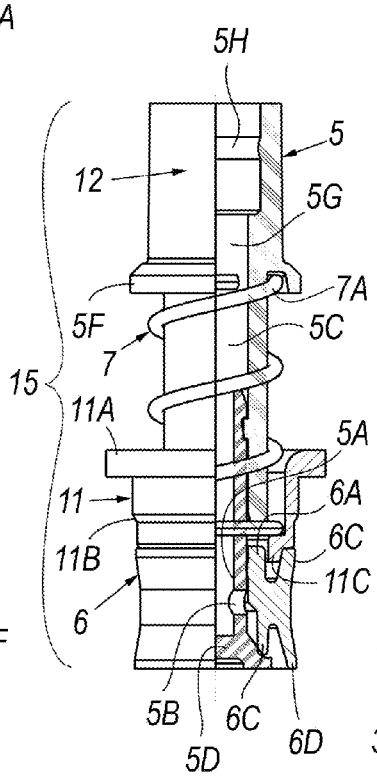
Figure 2C:
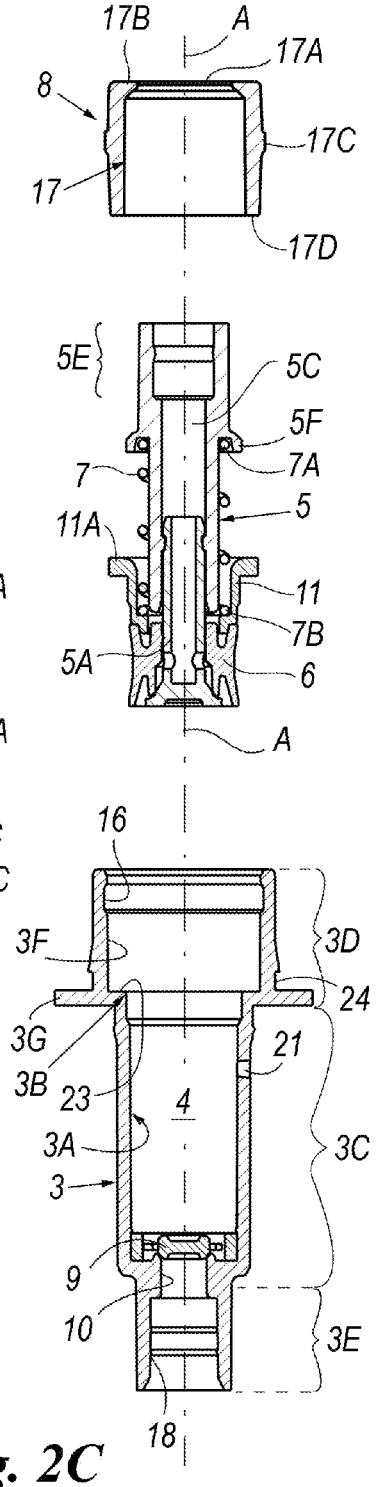
Figure 3C:
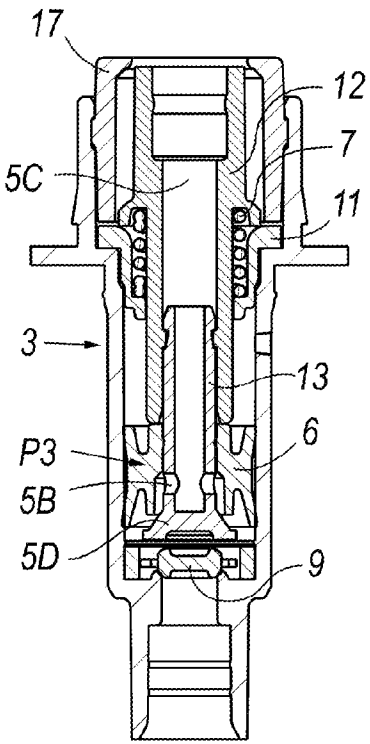
Figure 3B:
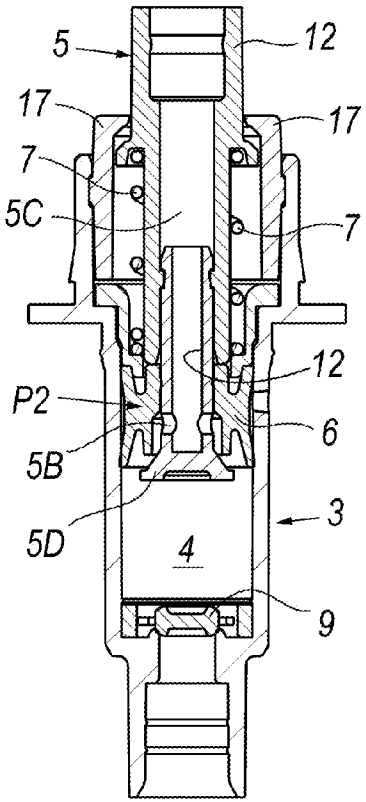
Figure 3A:
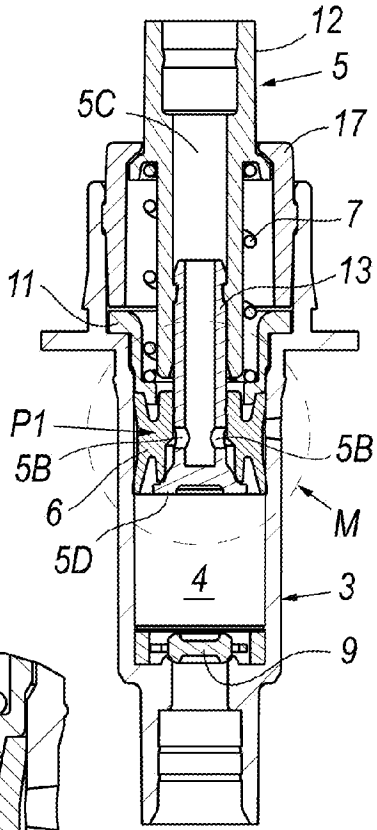
Figure 3D:
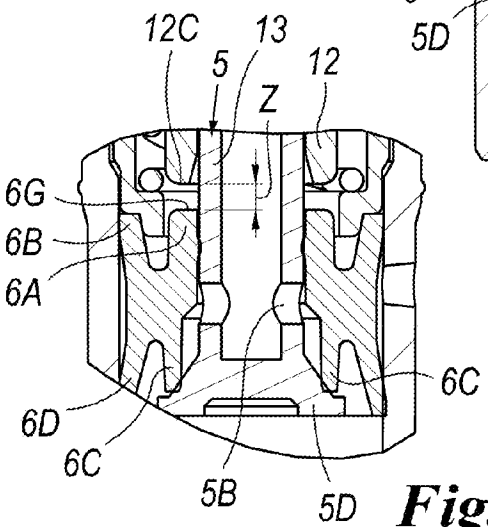
Figure 4A:
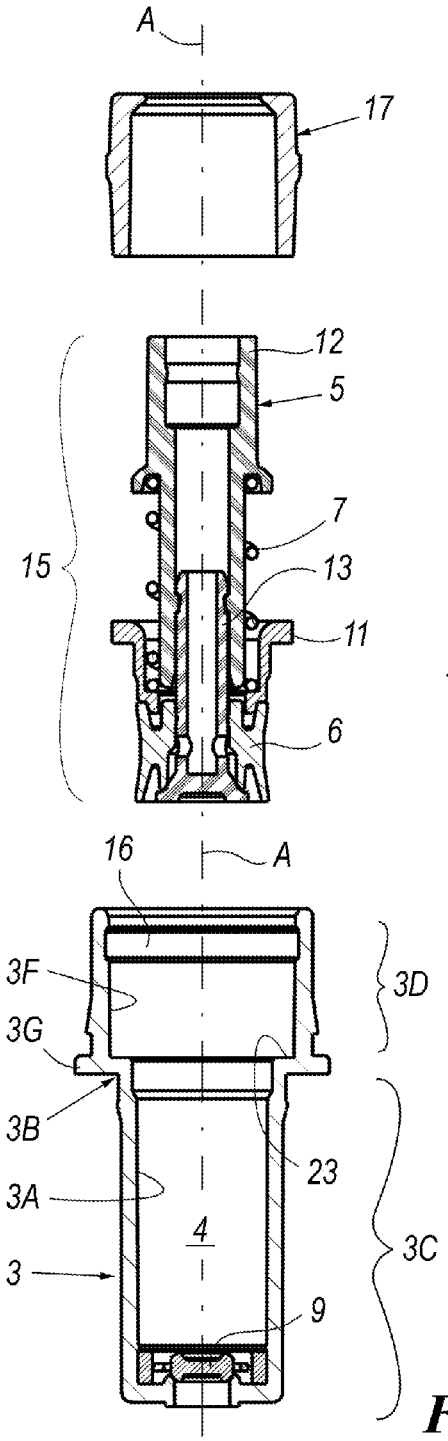
Figure 4B:
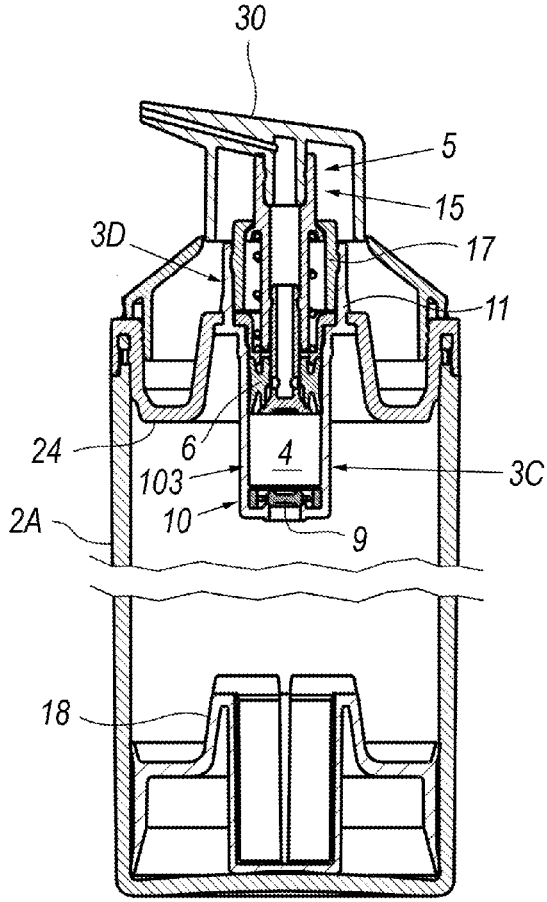
Figure 5A:
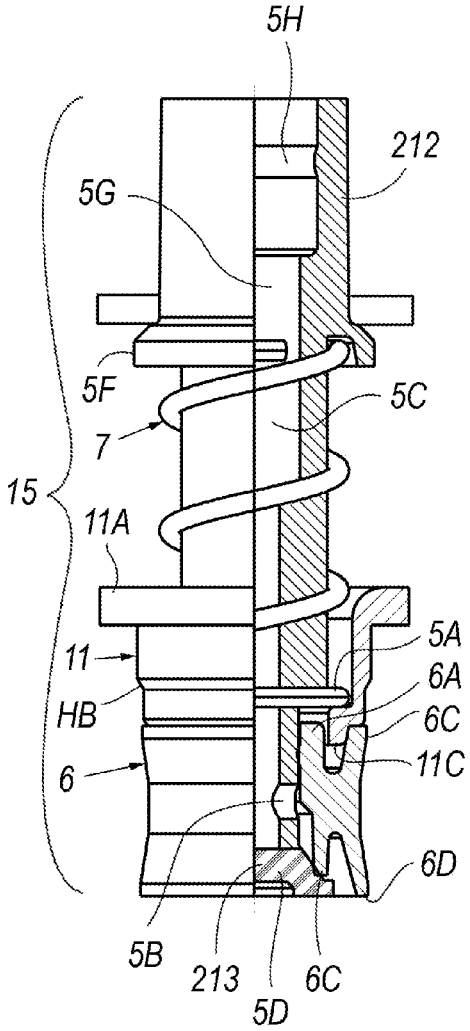
Figure 5B:
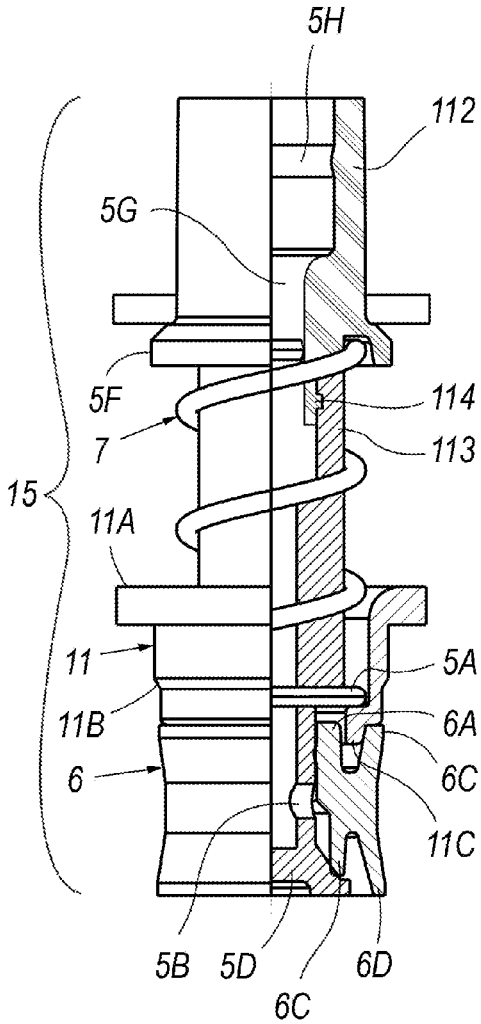
Figure 5C:
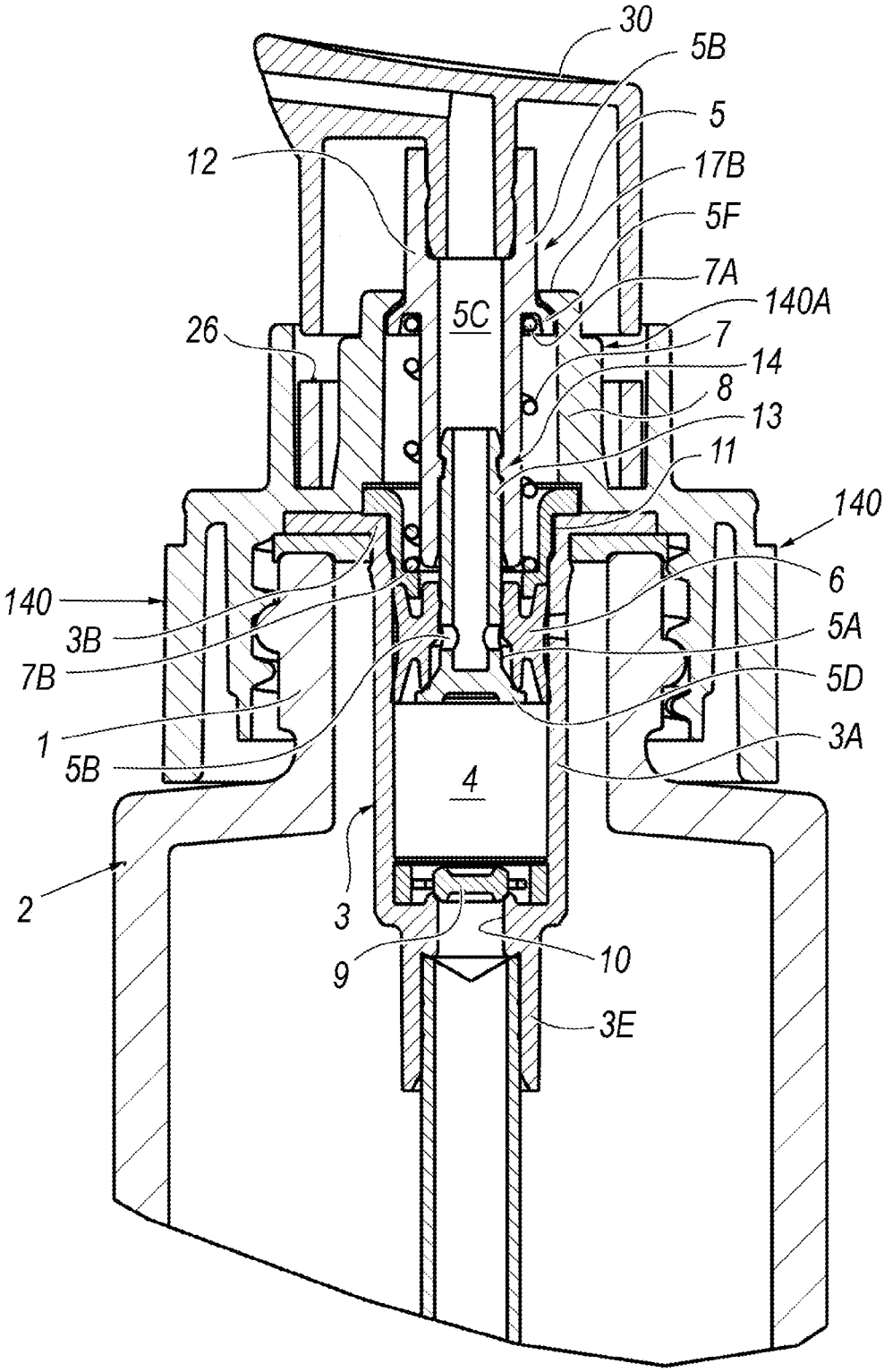

For a better understanding of the present invention, attached hereto by way of non-limiting example are the following drawings, in which:

FIG. 1 shows a schematic cross-sectional view of a pump according to the invention, applied to a first container (partially represented) and designed to provide a first type of pump;

FIGS. 2A, 2B, and 2C show partially sectioned views at different scales of an assembly for pressurization and dispensing of fluid substances for said pump;

FIGS. 3A, 3B, 3C, and 3D are schematic cross-sectional views thereof in different operating conditions, FIG. 3*d* showing an enlargement of the detail indicated by the arrow M of FIG. 3A;

FIGS. 4A and 4B show cross-sectional views of a pump according to the invention applied to a second container (represented in FIG. 4B) and designed to provide a second type of pump; and FIGS. 5A, 5B, 5C show partially sectioned views of two variants of the assembly for pressurization and dispensing of fluid substances for said pump and of a variant of the member for connection of the pump to a container.

With reference to the above figures, illustrated therein is an assembly for pressurization and dispensing of fluid substances for a manually operated pump (shown in FIGS. 1 and 4), in which said pump has a cup-shaped body 3.

The assembly comprises:

- a hollow elongated stem 5 having an annular fluid-tight piston 6 mounted on a first end 5A of the stem 5;
- a spring 7, one end 7A of which bears upon a projecting collar 5F, which is made of a single piece with the stem 5 at a second end 5E of said stem 5;
- an element 11 for retention of the other end 7B of said spring 7, said retention element 11 having a shaped outer portion 11A that can be fastened to the cup-shaped body 3;
- said piston 6 being slidable in a fluid-tight way on the surface of a cylindrical portion of said first end 5A of the hollow stem 5;
- said piston 6 being mobile between:
- a first, closing, position P1, in which it closes in a fluid-tight way, under the thrust of said spring 7, at least one hole 5B that traverses the thickness of the stem in the proximity of its first end 5A and opens into the cavity 5C of the stem 5, and in which said piston 6 bears in a fluid-tight way upon a widened end portion 5D of the stem 5 that is fastened to said stem, said widened end portion 5D closing said cavity 5C of the stem 5 in a fluid-tight way at said first end 5A thereof; and
- at least one second position P2, in which, by compressing said spring 7 further, the piston 6 is raised away from said at least one hole 5B of the stem 5 and from said widened end portion 5D;
- the ensemble of said stem 5, spring 7, piston 6, and retention element 11 forming a unitary assembly 15 that can be coupled to a cup-shaped body 3 of said pump.

It should be emphasized that, in the present context, by "unitary assembly" or "unitary body" is understood an element formed by a plurality of distinct components that are, however, associated to one another by connection means shaped so as to guarantee a stable and reliable connection of said components once they have been associated to one another so that said unitary assembly can in effect be treated as a body made of a single piece and can be handled by the usual machines for automatic assemblage of pumps without any danger of its components possibly detaching from one another.

The pump incorporating the unitary assembly previously described is designed to be fastened to the mouth 1 of a container 2 (partially represented in FIG. 1) containing said product.

The pump comprises the cup-shaped body 3 delimiting a chamber 4 for suction/compression of the product to be dispensed, in which the hollow stem 5 extends at least partially.

The chamber 4 is delimited by: a wall 3A of the cup-shaped body 3; a one-way valve 9, designed to close a hole 10 for inlet of the product to be dispensed into said chamber 4; the annular piston 6; and the widened end portion 5D of the stem.

The piston 6 is slidable in a fluid-tight way on the inner surface of the chamber 4, and on a cylindrical portion of the end 5A of the hollow stem 5.

Preferably, the element 11 for retention of the second end 7B of the spring 7 has the portion 11A shaped so as to rest on the mouth 3B of the cup-shaped body 3.

Preferably, the stem 5 comprises at least one first hollow tubular element 12 and one second hollow tubular element 13, which are partially inserted into one another and have members 14 designed to fasten them together. The first tubular element 12 extends at least partially on the outside of the cup-shaped body 3 and has the collar 5F for resting the first end 7A of the spring 7. This collar is made of a single piece with the tubular element 12 so as to guarantee at all times a firm connection of the spring to the stem and to prevent any accidental detachment of the spring from the stem when the assembly, once assembled, is not connected to the pump.

The second tubular element 13 presents the inlet hole 5B of the cavity 5C of the stem 5 and also comprises the widened end portion 5D for resting of the piston 6. Preferably, the cup-shaped body 3 has, in positions corresponding to its mouth and top part 3D, elements 16 for engagement to a ring 17 that delimits a hole 17A (FIG. 2C), extending through which is the free end 5E (FIG. 2C) of the first element 12 of the stem 5, said ring having a shaped portion 17B for retention of the collar 5F of the stem 5, which is designed to prevent exit of the stem 5 from said hole 17A under the thrust of the spring 7.

More particularly, the cup-shaped body 3 has a bottom part 3C (FIG. 2C) comprising the chamber 4 and the valve 9, which are both of a substantially traditional type (not described in detail in what follows), and a top part 3D. The bottom part 3C underneath the one-way valve 9 has a terminal portion 3E (FIG. 2C), which can be shaped in different ways, all of which, however, being conventional for the person skilled in the field, according to the type of pump that is to be obtained. Thus, in FIGS. 1-3 the portion 3E has a hollow cylindrical seat 18 (FIG. 2C) designed to house a dripping tube 27, whilst, in FIG. 4, the cup-shaped body 103 is without said terminal portion 3E because the pump is associated to a conventional container 2A provided with a usual bottom element 18, which is mobile upwards as the fluid contained in the container is dispensed. The chamber 4 can be provided with a hole in its top part. In addition, provided at the mouth 3B of the chamber 4 is an annular step 23 (FIG. 2C) upon which a similar step 11B provided in the outer wall of the retention element 11 can bear (FIG. 2A).

The top part 3D (FIG. 4A) of the cup-shaped body is innovative and has a tubular wall 3F coaxial with the wall 3A of the chamber 4, but having a larger diameter, said wall 3F being internally radiused to the first wall 3A by a horizontal stretch 23 (FIG. 2C), which delimits the mouth 3B of the chamber 4 and functions as a contrast surface for the annular top edge 11A of the retention element 11. The two tubular walls 3A and 3F are provided externally with an annular wall 3G (FIG. 2C), which projects in a direction perpendicular to the axis A of said two tubular walls and is designed to rest against a conventional gasket 22 (FIG. 1) provided on the top edge of the neck 1 for fastening the pump to the container itself. The wall 3G, together with an annular groove 24 provided immediately above it, is also designed to function as contrast surface and seat for a conventional member 40 designed to fasten the pump stably to the neck of a container, said member 40 may, for example, be of the screw type, as represented in FIGS. 1-3, or of the type designed to be clinched, as represented in FIG. 4. The wall 3F has at the top, in a position corresponding to its mouth, the elements 16 for engagement to the ring 17, said elements 16 are preferably shaped like a recessed annular groove so as to provide a seat for snap coupling with a corresponding annular projection 17C provided on the ring 17 (FIG. 2C).

The piston 6 has (FIG. 2A) a body comprising two top arms 6A and 6B, which are separated by an annular cavity 6F, and two bottom arms 6C and 6D, which are also separated by an annular cavity 6E. The outer top arm 6B and bottom arm 6D are designed to slide in a fluid-tight way on the inner face of the wall of the chamber 4 during motion of the piston, whereas the inner top arm 6A is designed to ensure tightness and to slide on the cylindrical portion of the end 5A of the hollow stem 5. The inner bottom arm 6E is, instead, mobile between a first position P1 (FIG. 3A), in which it closes the inlet hole 5B of the cavity 5C of the stem 5 in a fluid-tight way and bears upon the widened end portion 5D of the stem 5, and a plurality of second positions P2 (FIGS. 3B, 3C), in which said arm 6E is raised away from said at least one hole 5B of the stem 5 and from said widened end portion 5D, enabling the fluid present in the chamber 4 to be dispensed, passing through said hole made in the stem. Preferably, the top annular cavity 6F is shaped in such a way that, when the pump is in the resting position (FIGS. 1 and 3A), the bottom annular edge 11C (FIG. 2A) of the retention element can penetrate at least partially therein. Said bottom annular edge is internally shaped like a step so as to provide a contrast surface for the bottom end 7B of the spring 7.

As has already been said, the stem comprises two elements 12 and 13, which are coupled to one another and delimit a channel 5G (FIG. 2B) for dispensing the fluid, which is closed at the bottom by the widened portion 5D of the other element 13 that forms the stem. The top element 12 has, at its top mouth an annular groove 5H (FIG. 2B) for snap coupling with a usual dispensing head 30 (FIG. 1).

The members 14, which are designed to fasten together the two elements 12 and 13 that form the stem 5, are preferably provided inside with the element 12, which has a larger diameter than that of an annular appendage 12A, which is designed to couple by snap action in a corresponding recessed annular seat 13A provided on the outer face of the other element 13. It should be emphasized that these fastening members 14 according to the invention are shaped in such a way that, once they are coupled to one another, the two elements 12 and 13 that constitute the stem 5 can no longer be separated from one another, except by applying an axial force of considerable intensity, so as to guarantee that the unitary assembly 15 made up of the ensemble of the stem 5, the spring 7, the piston 6, and the retention element 11 form a body that is equivalent to a component made of a single piece that guarantees that its parts cannot detach from one another.

The spring 7, the piston 6, and the retention element 11 have a through hole so that they can be fitted on the stem. According to the invention the spring 7, the piston 6, the retention element 11, and the first tubular element 12 and second tubular element 13 of the stem 5 are shaped so that they can be inserted in series on top of one another, during assemblage of the unitary assembly 15, as follows: the spring 7 on a stretch of the first tubular element 12; at least one portion of the retention element 11 on a free end stretch of the spring 7; and at least one portion 6F of the piston 6 on an end edge 11C of said retention element 11, and, thus, so that the second tubular element 13 can be inserted into a central hole of said piston 6 and in an internal end stretch of the first tubular element 12. More in particular, the spring 7 has an inner diameter slightly larger than the outer diameter of the element 12 of the stem 5 having larger diameter so that it can be fitted on said element 12 and bear with its top end 7A upon the collar 5F. The retention element 11 has a flared hole, the bottom edge of which has a diameter substantially the same as that of the spring 7 and a step, designed to constitute a contrast surface for the bottom end of said spring 7, and a top edge 11A of larger diameter, which is designed to rest on the mouth 3B of the chamber 4 of the cup-shaped body 3. As has already been described previously, the piston 6 has a conformation with two arms, a top one 6A and a bottom one 6C, which delimit a hole, where the top arm 6A is designed to rest in a fluid-tight way on the outer face of the wall that delimits the bottom part of the other element 13 that forms the stem 5. Thanks to this particular conformation of the components of the unitary assembly 15, its assemblage proves particularly simple and fast. It is, in fact, sufficient to fit in succession on the element 12 of the stem: the spring 7, the retention element 11, and the piston 6, and then to insert into the internal hole of the piston the other element 13 that forms the stem and push it inside the other element 12 until they are coupled together by snap action through the fastening member 14. It should be emphasized that, according to the invention, the unitary assembly 15 can be assembled independently of the cup-shaped body 3. This presents, on the one hand, the advantage of being able to assemble the unitary assemblies 15 also at a different time from when the cup-shaped bodies 3 are produced, and on the other hand also the advantage of being able to associate the unitary assembly 15 to cup-shaped bodies having characteristics that are different to one another as regards the members for intake of the fluid from the container, for example cup-shaped bodies with dripping tube 27 (FIG. 1) or without said tube (FIG. 3).

The unitary assembly 15, once assembled, is associated to the preselected cup-shaped body (for example, of the type with dripping tube 27 of FIG. 1), then fitting thereon the ring 17 and then inserting the ensemble formed by the unitary assembly and the ring into the cup-shaped body 3, until they are fastened together. For this purpose, as has already been highlighted previously, the cup-shaped body 3 and the ring 17 have snap-action fastening members, which comprise the engagement element 16 and the corresponding annular projection 17C. It should be pointed out that the ring and the cup-shaped body 3, once they are fastened to one another, fasten together in a correct position also the unitary assembly 15 and the cup-shaped body, albeit enabling a travel, countering the spring 7, of the stem and of the piston associated thereto in the chamber 4. In fact, the ring 17, thanks to its shaped portion 17B for retention of the collar 5F of the stem 5, is designed to prevent exit of the stem 5 from the hole 17A of the ring itself, under the thrust of the spring 7, and, at the same time, by means of its bottom edge 17C (FIG. 2C), is designed to keep the retention element 11 in contact with the edge 3B of the mouth of the chamber 3.

Thanks to the presence of the ring 17, it is moreover possible to modify in an extremely simple and fast way the amount of fluid dispensed without having to modify or replace the dispensing/pressurization assembly 15. In fact, if it is desired to reduce the amount of fluid dispensed, it will be sufficient to replace the ring 17 represented in the drawings with a ring having the same features, but a smaller height. Since the ring functions also as end-of-travel for the collar 5F of the stem upon which the top end of the spring 7 comes to bear, by reducing the height of the ring 17, also the volume of the chamber 4 is reduced because the stem 5 and the piston 6, when the pump is at rest, come to occupy a position closer to the base of the cup-shaped body, i.e., more internal to the chamber 4 of said cup-shaped body, thus reducing the volume of said chamber. In order to reduce the amount of fluid dispensed by the pump it is hence simply necessary to replace the ring 17 with a ring of smaller height, without having to modify the unitary assembly 15 or the cup-shaped body 3 in any way.

FIGS. 3A-C illustrate operation of the pump.

FIG. 3A shows the pump in the resting position P1. In this position, the chamber 4 is full of the fluid to be dispensed, and the piston 6, as shown in FIG. 3D, with its inner bottom arm 6C resting against the bottom end portion 5D of the stem 5, blocks the connection between said chamber 4 and the cavity of the stem itself (through the bottom hole 5B of said stem 5). It should be emphasized that, in this position, as shown in FIG. 3D, the bottom edge 12C of the element 12 of the stem 5 is set apart by a stretch Z, which preferably extends for a few millimeters, from the top edge 6G of the piston 6. FIG. 3B shows a further operating position P2 of the pump, where the stem has been lowered just by a stretch equal to the stretch Z mentioned above, i.e., until the bottom edge 12C of the element 12 of the stem comes into contact with the top edge 6G of the piston 6. In this operating position P2, the piston has remained stationary by friction with the inner wall of the chamber 4, and only the stem 5 has moved downwards. Consequently, the arm 6C has detached from the bottom end 5D of the stem 5, thus opening the pump, i.e., the connection between the chamber 4 and the cavity 5C of the stem 5 through the hole 5B.

Next, the stem 5, continuing its travel downwards, draws along with it also the piston 6 (because the edge 12C of the element 12 of the stem pushes on the top edge 6G of the piston) and dispenses all the fluid contained in the chamber 4. FIG. 3C shows an operating position P3, in which the stem is at the end of travel and the hole 5B of the stem is still open. In this position, the projection 5F of the stem preferably bears upon the top edge 11A of the retention element 11. Next, by releasing the stem 5, the latter, by action of the spring 7, returns into its initial position, thus drawing the piston 6 upwards and closing the hole 5B of the stem 5, and once again filling the chamber 4 by suction pressure.

As shown in FIGS. 1-3 and 4, the pump according to the invention can envisage, with an identical unitary assembly 15, different types of cup-shaped bodies 3 (FIGS. 1-3) and 103 (FIG. 4) and consequently can be associated to different types of containers 2 and 2A, simply by varying just one component of the pump itself (the cup-shaped body 3), thus optimizing assemblage of the pump itself.

It should moreover be emphasized that the pump according to the invention can be provided with a further element designed to regulate the amount of fluid dispensed. Said element is a simple ring 26 (FIG. 1) fitted on the outside of the top wall 3D of the cup-shaped body and designed to limit the travel downwards of the dispensing head associated to the stem 5 and consequently the amount of fluid dispensed by the pump. By varying the height of the ring, the amount of fluid dispensed varies.

Finally, it should once again be emphasized that the embodiments so far illustrated have been provided purely by way of example and that numerous other embodiments are possible, all of which fall within the scope of the same inventive idea.

According to a first embodiment, the stem 5 could be shaped in a way different from what has so far been described. According to the invention, the first and second parts of the stem and the corresponding means for fastening said two parts together could have a shape different from the ones so far illustrated. According to the invention, it is in fact sufficient for these two elements to be shaped in such a way that:

when said two elements are separated from one another, it is possible to fit, on at least one of them:

the spring 7, the piston 6, and the retention element 11, and subsequently to fasten said two elements of the stem together in a fluid-tight way.

Thus, for example, FIG. 5A shows a first variant of the stem that envisages a first part 212, which comprises, with reference to the embodiment referred to previously, both the projecting collar 5F and the bottom hole 5B for inlet of the fluid into the cavity 5C of the stem itself, whereas the second part 213 envisages what, in the previous embodiment, was referred to as bottom widened end 5D of the stem. The two parts 212 and 213 of the stem according to this first variant, once the spring, the retention element, and the piston have been inserted on the first part 212, are fastened to one another in a fluid-tight way, for example by means of gluing or ultrasound welding or using any other conventional technique for joining said two elements in a fluid-tight way. According to a second variant of the stem shown in FIG. 5B, the latter envisages a first part 112, which comprises, with reference to the embodiment of FIGS. 1-3, the projecting collar 5F, and a second part, which comprises the bottom hole 5B for inlet of the fluid into the cavity 5C of the stem itself and the widened end 5D. The two parts 112, 113 are partially inserted inside one another at the portion of the stem that houses the top end 7A of the spring 7 and are connected in a fluid-tight way by means of a snap coupling 114 of a type similar to the one described for connection of the two parts 12, 13 of FIGS. 1-3.

According to a further embodiment, the connection of the unitary assembly 15 to the cup-shaped body and to the neck 1 of the container 2 could be obtained with devices alternative to the ones so far described (which envisage the use of a ring 17 that couples by snap action with a part 3D of the cup-shaped body). For example, FIG. 5C shows an alternative arrangement, in which the member 140 that is designed to fasten the ensemble of the unitary assembly 15 and cup-shaped body 3 to the neck 1 of the container is also at the same time designed to fasten together said assembly 15 and said body 3, and for said purpose envisages a part 140A made of a single piece with the remaining part of the member 140 and shaped substantially like the ring 17 and the top part 3D of the cup-shaped body, described previously.

According to a further embodiment of the invention, the retention element 11 could be connected to the cup-shaped body 3 in a way different from what has been illustrated so far, which envisages resting of the edge 11A of the element 11 on the mouth 3B of the chamber 4 of the cup-shaped body 3. According to said embodiment, it is sufficient for the retention element 11 to have an outer portion shaped so that it is able to couple with a corresponding portion provided on the cup-shaped body and to guarantee that the element 11 cannot shift axially under the thrust of the spring. Said coupling could be provided also by simply forcing the element 11 into the cup-shaped body 3.

According to further possible embodiments of the invention, the members for connection of the various components of the pump associated to one another could be different from the ones so far illustrated, albeit of a conventional type for the person skilled in the field, and/or a container could envisage two pumps associated to the neck of one and the same container, and with a single dispenser for both of the pumps or a separate dispenser.

The invention claimed is:

1. A manually operated pump for pressurized dispensing of a fluid product, designed to be fastened to the mouth of a container containing said product, said pump comprising:

a cup-shaped body delimiting a chamber for suction/compression of the product to be dispensed;

an assembly for pressurization and dispensing of said fluid product, said assembly comprising:

a hollow elongated stem having an annular fluid-tight piston, mounted on a first end of the stem;

a spiral spring, one first end of which bears upon a first retention element projecting from the stem at a second end of said stem;

a retention element for retention of the other end of said spring, said retention element having at least one shaped outer portion, constituting an element for resting on the cup-shaped body of said pump;

said piston being slidable in a fluid-tight way on the outer surface of a cylindrical portion of said first end of the hollow stem, said piston being mobile between a first, closing, position in which it closes in a fluid-tight way, under the thrust of said spring, at least one hole that traverses the thickness of the stem in the proximity of its first end and opens into the cavity of the stem, and in which said piston bears in a fluid-tight way upon a widened end portion of the stem that is fastened to said stem, said widened end portion closing said cavity of the stem at said first end thereof, and at least one second position, in which, by compressing said spring further, the piston is raised away from said at least one hole of the stem and from said widened end portion, wherein an ensemble of the hollow elongated stem, the spiral spring, the annular fluid-tight piston, and the retention element form a unitary assembly that can be coupled to said cup-shaped body of said pump; and a member for connection of said unitary assembly to said cup-shaped body;

wherein the connection member comprises a shaped portion for retention of a collar that projects from the stem, said portion preventing the exit of the stem from the cup-shaped body when said unitary assembly is inserted into the cup shaped body;

the shaped retention portion of the connection member is provided in an annular element or ring delimiting a hole, through which a free end of the stem of said unitary assembly extends;

the cup-shaped body envisages has a portion for engagement of said annular element; and said engagement portion and said annular element have at least one shaped part for their mutual engagement;

wherein the portion for engagement of the cup-shaped body comprises a tubular wall, coaxial with the wall that delimits the chamber of said cup-shaped body, and said shaped engagement part is provided on said tubular wall.

2. The pump according to claim 1, wherein a tubular wall has a diameter different from that of the coaxial wall that delimits the chamber, and said two walls are radiused internally by a wall that delimits the mouth of the chamber and functions as contrast surface for a top annular edge of a retention element of the unitary assembly.

3. The pump according to claim 1, wherein the cup-shaped body has on the outside a projecting annular wall, designed to rest on the neck of the container.

4. The pump according to claim 1, wherein the components of the unitary assembly are assembled independently of the cup-shaped body, so the unitary assembly is made independently of said cup-shaped body, and/or the unitary assembly can be associated to a plurality of different cup-shaped bodies, said plurality of different cup-shaped bodies all having identical members for connection of the unitary assembly and having each a bottom part for intake of the fluid to be dispensed, said bottom parts being of different types and/or having a different volume of their suction chamber.

5. The pump according to claim 1, wherein the annular element comprises a bottom edge designed to keep the retention element of the unitary assembly and the edge of the mouth of the chamber in contact with one another when said annular element is associated to the cup-shaped body.

6. The pump according to claim 1, wherein it comprises an element designed to regulate the amount of fluid dispensed, said element comprising a ring fitted externally on the top portion of the cup-shaped body and being designed to limit the travel downwards of a dispensing cap mounted on the free end of the stem of the unitary assembly and consequently the amount of fluid dispensed by the pump.

7. A manually operated pump for pressurized dispensing of a fluid product, designed to be fastened to the mouth of a container containing said product, said pump comprising:

a cup-shaped body delimiting a chamber for suction/compression of the product to be dispensed;

an assembly for pressurization and dispensing of said fluid product, said assembly comprising:

a hollow elongated stem having an annular fluid-tight piston, mounted on a first end of the stem;

a spiral spring, one first end of which bears upon a first retention element projecting from the stem at a second end of said stem;

a retention element for retention of the other end of said spring, said retention element having at least one shaped outer portion, constituting an element for resting on the cup-shaped body of said pump;

said piston being slidable in a fluid-tight way on the outer surface of a cylindrical portion of said first end of the hollow stem, said piston being mobile between a first, closing, position in which it closes in a fluid-tight way, under the thrust of said spring, at least one hole that traverses the thickness of the stem in the proximity of its first end and opens into the cavity of the stem, and in which said piston bears in a fluid-tight way upon a widened end portion of the stem that is fastened to said stem, said widened end portion closing said cavity of the stem at said first end thereof, and at least one second position, in which, by compressing said spring further, the piston is raised away from said at least one hole of the stem and from said widened end portion, wherein an ensemble of the hollow elongated stem, the spiral spring, the annular fluid-tight piston, and the retention element form a unitary assembly that can be coupled to said cup-shaped body of said pump; and a member for connection of said unitary assembly to said cup-shaped body;

wherein the connection member comprises:

a shaped portion for retention of a collar that projects from the stem, said portion preventing the exit of the stem from the cup-shaped body when said unitary assembly is inserted into the cup-shaped body; and a bottom edge designed to keep the second retention element of the unitary assembly and an edge of a mouth of the chamber of the cup-shaped body in contact with one another when said connection member is associated to the cup-shaped body;

wherein the shaped retention portion of the connection member is provided in an annular element or ring delimiting a hole, through which a free end of the stem of said unitary assembly extends;

the cup-shaped body has a portion for engagement of said annular element; and said engagement portion and said annular element have at least one shaped part for their mutual engagement;

wherein the portion for engagement of the cup-shaped body comprises a tubular wall, coaxial with the wall that delimits the chamber of said cup-shaped body, and said shaped engagement part is provided on said tubular wall; wherein a tubular wall has a diameter different from that of the coaxial wall that delimits the chamber, and said two walls are radiused internally by a wall that delimits the mouth of the chamber and functions as contrast surface for a top annular edge of a retention element of the unitary assembly.

8. The pump according to claim 7, wherein the cup-shaped body on the outside a projecting annular wall, designed to rest on the neck of the container.

9. The pump according to claim 7, wherein the components of the unitary assembly are assembled independently of the cup-shaped body, so that the unitary assembly is made independently of said cup-shaped body, and/or the unitary assembly can be associated to a plurality of different cup-shaped bodies, said plurality of different cup-shaped bodies all having identical members for connection of the unitary assembly and having each a bottom part for intake of the fluid to be dispensed, said bottom parts being of different types and/or having a different volume of their suction chamber.

10. The pump according to claim 7, wherein it comprises an element designed to regulate the amount of fluid dispensed, said element comprising a ring fitted externally on the top portion of the cup-shaped body and being designed to limit the travel downwards of a dispensing cap mounted on the free end of the stem of the unitary assembly and consequently the amount of fluid dispensed by the pump.

11. A manually operated pump for pressurized dispensing of a fluid product, designed to be fastened to the mouth of a container containing said product, said pump comprising:

a cup-shaped body delimiting a chamber for suction/compression of the product to be dispensed;

an assembly for pressurization and dispensing of said fluid product, said assembly comprising:

a hollow elongated stem having an annular fluid-tight piston, mounted on a first end of the stem;

a spiral spring, one first end of which bears upon a first retention element projecting from the stem at a second end of said stem;

a retention element for retention of the other end of said spring, said retention element having at least one shaped outer portion, constituting an element for resting on the cup-shaped body of said pump;

said piston being slidable in a fluid-tight way on the outer surface of a cylindrical portion of said first end of the hollow stem, said piston being mobile between a first, closing, position in which it closes in a fluid-tight way, under the thrust of said spring, at least one hole that traverses the thickness of the stem in the proximity of its first end and opens into the cavity of the stem, and in which said piston bears in a fluid-tight way upon a widened end portion of the stem that is fastened to said stem, said widened end portion closing said cavity of the stem at said first end thereof, and at least one second position, in which, by compressing said spring further, the piston is raised away from said at least one hole of the stem and from said widened end portion;

wherein an ensemble of the hollow elongated stem, the spiral spring, the annular fluid-tight piston, and the retention element form a unitary assembly that can be coupled to said cup-shaped body of said pump; and a member for connection of said unitary assembly to said cup-shaped body; wherein:

a) said stem is provided with a projecting collar, b) said connection member is provided with an annular element, c) an upper edge of said connecting member being provided with a shaped portion for retention of said projecting collar of the stem, d) said shaped portion preventing the exit of the stem from the cup-shaped body when said unitary assembly is inserted into the cup shaped body, e) a bottom edge of said connection member being designed to keep the second retention element of the unitary assembly and an edge of a mouth of the chamber of the cup shaped body in contact with one another when said connection member is associated to the cup shaped body;

f) the cup shaped body being provided with a tubular upper wall portion comprising in its inner side a portion for engagement of said annular element;

g) said annular element having a diameter less than that of said tubular upper wall portion of the cup shaped body;

wherein the shaped retention portion of the connection member is provided in an annular element or ring delimiting a hole, through which a free end of the stem of said unitary assembly extends;

the cup-shaped body has a portion for engagement of said annular element; and said engagement portion and said annular element have at least one shaped part for their mutual engagement;

wherein the portion for engagement of the cup-shaped body comprises a tubular wall, coaxial with the wall that delimits the chamber of said cup-shaped body, and said shaped engagement part is provided on said tubular wall.

12. The pump according to claim 11, wherein the cup-shaped body has on the outside a projecting annular wall, designed to rest on the neck of the container.

13. The pump according to claim 11, wherein the components of the unitary assembly are assembled independently of the cup-shaped body, so that the unitary assembly is made independently of said cup-shaped body, and/or the unitary assembly can be associated to a plurality of different cup-shaped bodies, said plurality of different cup-shaped bodies all having identical members for connection of the unitary assembly and having each a bottom part for intake of the fluid to be dispensed, said bottom parts being of different types and/or having a different volume of their suction chamber.

14. The pump according to claim 11, wherein it comprises an element designed to regulate the amount of fluid dispensed, said element comprising a ring fitted externally on the top portion of the cup-shaped body and being designed to limit the travel downwards of a dispensing cap mounted on the free end of the stem of the unitary assembly and consequently the amount of fluid dispensed by the pump.

* * * * *